US006746294B1

(12) United States Patent
Kishi et al.

(10) Patent No.: US 6,746,294 B1
(45) Date of Patent: Jun. 8, 2004

(54) METHOD FOR FABRICATING A FLAT, LIGHT-EMITTING DISPLAY PANEL

(75) Inventors: Hisatoshi Kishi, Tokyo (JP); Hideo Yamada, Tokyo (JP); Isamu Makita, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 24 days.

(21) Appl. No.: 10/088,908

(22) PCT Filed: Aug. 7, 2000

(86) PCT No.: PCT/JP00/05289

§ 371 (c)(1),
(2), (4) Date: Mar. 25, 2002

(87) PCT Pub. No.: WO02/13223

PCT Pub. Date: Feb. 14, 2002

(51) Int. Cl.[7] ..... H01J 9/00; H01J 9/24
(52) U.S. Cl. ..... 445/24
(58) Field of Search ..... 445/24, 25; 313/581, 313/582, 587

(56) References Cited

U.S. PATENT DOCUMENTS

| | | | | |
|---|---|---|---|---|
| 6,059,626 A | * | 5/2000 | Kimura et al. | 445/24 |
| 6,077,140 A | * | 6/2000 | Kimura et al. | 445/24 |
| 6,208,084 B1 | * | 3/2001 | Urakabe et al. | 315/169.4 |
| RE37,219 E | * | 6/2001 | Takahara et al. | 349/92 |
| 6,323,596 B1 | * | 11/2001 | Ito et al. | 315/169.3 |
| 6,528,944 B1 | * | 3/2003 | Kishi et al. | 313/582 |
| 6,555,960 B1 | * | 4/2003 | Kishi et al. | 313/582 |

FOREIGN PATENT DOCUMENTS

| | | | | |
|---|---|---|---|---|
| EP | 0580868 | | 2/1994 | |
| EP | 991098 | A2 * | 4/2000 | H01J/17/49 |
| EP | 991099 | A2 * | 4/2000 | H01J/17/49 |
| JP | 7-307131 | | 11/1995 | |
| JP | 2000-106093 | | 4/2000 | |
| JP | 2000-133134 | | 5/2000 | |
| WO | 96/14651 | | 5/1996 | |
| WO | 98/44531 | | 10/1998 | |

* cited by examiner

*Primary Examiner*—Sandra O'Shea
*Assistant Examiner*—Peter Macchiarolo
(74) *Attorney, Agent, or Firm*—Oblon, Spivak, McClelland, Maier & Neustadt, P.C.

(57) ABSTRACT

A method for fabricating a flat, light-emitting display panel includes the steps of applying frit seal to the pin electrodes in a state of pressing the rear panel against the front panel to keep them in contact with one another using a flat plate having an opening formed at a position corresponding to each of the pin electrodes; drying the frit seal to fix provisionally the rear panel to the front panel; detaching the flat plate from the both panels; applying frit seal to an end of the front panel and a side face of the rear panel; and burning the whole of components. The sequence of the application of the frit seal to the pin electrode and the application of the frit seal to the end of the front panel and the side face of the rear panel may be altered. The frit seal having flowability less than the frit seal applied to the pin electrode is applied to the end of the front panel and the side face of the rear panel.

10 Claims, 6 Drawing Sheets

METHOD FOR FABRICATING A FLAT, LIGHT-EMITTING DISPLAY PANEL

TECHNICAL FIELD

The invention relates to a method for fabricating a flat, light-emitting display panel having electrodes extended from a rear panel and sealing the margin of panels with a fritted glass.

BACKGROUND ART

Generally, it is difficult to construct a large-screen monitor including only one display panel (hereafter, referred to as "panel") due to various technical reasons and the need to reduce cost. Therefore, multiple panels are tiled to form a large-screen monitor.

In a case where no-display area at ends of each panel is large, seams are formed between the adjacent panels and as a result, an image quality of the large-screen as a whole is reduced significantly. Therefore, it is desirable to develop a flat light-emitting display panel with smaller no-display area at ends of each panel in order to display a high quality image on a large-screen monitor.

The applicants previously propose a structure of the flat, light-emitting display panel formed from a matrix of the plural panels to fit such a need.

FIG. 1 is a cross sectional view of a side-seal structure of the flat light-emitting display panel (hereafter, referred to as "display panel") disclosed in the previous, co-pending application. In the drawing, a reference numeral 1 denotes a transparent front panel. A reference numeral 2 denotes a rear panel, which is arranged in parallel with the front panel 1 and has a plurality of recesses 2*a*. Each recess 2*a* is defined as a discharging space for a display cell. Although not shown in FIG. 1, FIG. 4 illustrates a display cell which is marked by reference numeral 21. An electrical insulating glass layer (not shown) is formed at a bottom face and an inner wall of each recess 2*a* of the rear panel 2. A fluorescent substance 3 is applied on the electrical insulating glass layer. A pin electrode (not shown) penetrating the rear panel 2 is arranged within the front panel 1. A pair of cell-type electrodes (not shown) is positioned corresponding to the recess 2*a* of the rear panel 2. Although not shown in FIG. 2, FIGS. 4 and 5 illustrate a pair of cell-type electrodes which is marked by reference numeral 20 and a pin electrode which is marked by reference numeral 6, respectively.

With such a constructed display panel, in order to reduce the no-displayed area in ends of display panel, the pin electrode 6 connecting with the electrode arranged at the front panel 1 is extended from the rear panel. The size of the front panel 1 is set to a value larger than that of the rear panel 2. A frit seal 4 is applied to an extended area 1*a* of the front panel 1 that extends off the rear panel 2 and to a side face 2*b* of the rear panel 2 and burned. As a result, the gap of the front panel 1 and the rear panel 2 is sealed.

Next, a method for fabricating a display panel will be explained in order of undergoing process.

(Step 1)

A transparent electrode (not shown) including a discharging gap is formed at the front panel 1 using an ITO (indium-tinned oxide) or a Nesa (tinned oxide), for example.

(Step 2)

Electric terminals are formed at one end of the transparent electrode (not shown) formed in the previous step 1 by a screen printing method using conductive materials such as an Ag or silver and so on.

(Step 3)

Electrical insulating glass layers (not shown) are formed at the whole of the front panel 1 except for the electric terminals (not shown) formed in the step 2.

(Step 4)

Pin electrodes (not shown) are projected in the electric terminals (not shown), respectively.

(Step 5)

A MgO film is formed on the electrical insulating glass layer (not shown) formed in the previous step 3 to finish all processes regarding the front panel 1.

(Step 6)

Recesses 2*a*, which are defined as a through-hole for passing through the pin electrode (not shown) and functioned as a discharging space for a display cell, are formed at the rear panel 2 using a sandblasting method and so on.

(Step 7)

Fluorescent substance (R: red, G: green, B: blue) 3 is applied to the bottom face and the inner wall of the recess 2*a* formed in the previous step 6 using the screen printing method and so on to finish all processes regarding the rear panel 2.

(Step 8)

Each of the pin electrodes (not shown) projected at the front panel 1 is fitted into each of the through-hole (not shown) of the rear panel 2. The rear panel 2 is stacked to the front panel 1 so that the fluorescent substance 3 faces the front panel 1.

(Step 9)

Ends of the front panel 1 and those of the rear panel 2 having no pin electrodes are stacked and fixed using a spring-loaded clip (not shown).

(Step 10)

A frit seal is applied to the pin electrode (not shown) using a dispenser (not shown).

(Step 11)

After the frit seal 4 applied in the previous step 10 is dried, the spring-quipped clip (not shown) is removed. The frit seal 4 is applied to a pipe-shaped, tipped section (not shown) and an outer periphery of the panel, that is, the extended area 1*a* of the front panel 1 and the side face 2*b* of the rear panel 2 using the dispenser (not shown).

(Step 12)

Weights (not shown) is placed at a part other than the pipe-shaped, tipped section (not shown) and the pin electrode (not shown) and the frit seal 4 is then burned. Air is exhausted from a space between the panels and discharge gas is filled and sealed in the space.

(Step 13)

The MgO adhered to the pin electrode (not shown) is removed using a sandblasting method and so on. In this way, a display panel is obtained.

When plural display panels, which are fabricated by the processes as described above and disclosed in the previous application, are arranged, lighted and displayed, there may be case where a display gap is formed between adjacent panels.

The present inventors investigated adequately the cause of gap in the display panel and found that a frit seal, which is formed at the extended area 1*a* of the front panel 1 and the side face 2*b* of the rear panel 2, is spread into the display cell. Namely, when the fluorescent substance 3 applied to the rear panel 2 or an area of the front panel 1 corresponding to the fluorescent substance 3 is covered with the frit seal spread into the display cell, light is not emitted or cut off from the covered section. Therefore, it results in no-emitting area or no-displayed area being increased at the ends of the display panel. The no-emitting area is considered to seem like a gap between adjacent panels.

A gap between the front and rear panels 1 and 2 when the frit seal 4 is applied to the extended area 1*a* of the front panel 1 and the side face 2*b* of the rear panel 2 is considered to become a cause of spread of the frit seal. In the step 11, the spring-loaded clip (not shown) is removed and a distance of a gap between the front panel 1 and the rear panel 2 is measured using a gap-measurement gage (not shown) before the gap is sealed with the frit seal. As a result, a gap of approximately 0.15 mm was found. When a large-sized gap is formed at the gap, the frit seal 4 is applied thereto to result in the frit seal 4 in a large amount being inserted into the gap. The frit seal 4 is burned in the step 12 to result in a softened frit seal 4 in a large amount being inserted into the cell.

Such a gap is formed due to warping of the front and the rear panels 1, 2, causing the front and the rear panels to be convex as shown in FIG. 3. The electrical insulating glass layer (not shown) is approximately 30 um in thickness is formed on a surface of the front panel 1. For example, when the ends of the both front and rear panels 1, 2 are cramped using the spring-loaded clip 5 as shown in FIG. 3, the distance between the central sections of the panels 1, 2 becomes larger compared to the end sections of the panels 1, 2. In order to prevent warping of the panels 1, 2, the pin electrodes located on the central section must be fixed provisionally using the frit seal 4. Next, in order to apply the frit seal 4 to the extended area 1*a* of the front panel 1 and the side face 2*b* of the rear panel 2, the spring-loaded clip 5 is removed. Further, this causes the gap to be formed between the ends of the panels 1, 2 as shown in FIG. 2.

Furthermore, the following other factors are considered to become a cause of the spread of the frit seal. That is, the frit seal 4 is softened at the side of the front panel 1 and the rear panel 2 on burning to pass through a micro-gap between the front and rear panels 1 and 2 by capillary action toward the cell. In order to decrease the spread of the frit seal, the flowability of the frit seal 4 must be set to become a small value on softening. Therefore, we have learned that the frit seal 4 must be burned on condition that the burning is performed at a low temperature or for a short time.

However, when the frit seal 4 is burned on such a condition, reduction of the spread of the frit seal 4 into the cell can occur. When a voltage is applied to the display panel, there are malfunctions that discharge occurs abnormally at the pin electrodes. There is a reason: when the frit seal 4 is burned on the condition above, the frit seal 4 having a low flowability can not flow adequately into the pin electrode. The pin electrode is coated inadequately with the frit seal 4 and the insulating properties are reduced. As a result, the discharge occurs abnormally when the voltage is applied to the display panel.

On the other hand, in order to coat perfectly the pin electrode, it is necessary to burn the frit seal 4 at a high temperature or for a long time. In such a case, there is a malfunction that the softened frit seal 4 applied to the ends of the panel is spread into the cell. That is, the coating of the pin electrode and the spreading of the frit seal applied to the ends of the panel are mutually contradictory and it is difficult to maintain compatibility between both sides.

The invention was made to solve the foregoing problems. Accordingly, it is an object of the invention to provide a method for fabricating a flat, light-emitting display panel that a pin electrode can be coated perfectly with a frit seal and that reduction of the spread of the frit seal into a cell can occur.

DISCLOSURE OF THE INVENTION

In order to achieve the object of the invention, we provide a method for fabricating a flat, light-emitting display panel including a transparent, front panel, a rear panel arranged in parallel to the front panel and having a plurality of recesses, each recess being defined as a discharging space for a display cell, a pin electrode projected inwardly in a state of penetrating the rear panel, and a pair of cell-type electrodes, which works at the presence of voltage from the pin electrodes, arranged at every area of the front panel facing each of the recesses of the rear panel, wherein the method comprises the steps of: applying frit seal to the pin electrodes in a state of pressing the rear panel against the front panel to keep them in contact with one another using a flat plate having an opening formed at a position corresponding to each of the pin electrodes; drying the frit seal to fix provisionally the rear panel to the front panel; detaching the flat plate from the both panels; applying frit seal to an end of the front panel and a side face of the rear panel; and burning the whole of components. In this way, both of the panels are fixed provisionally on condition that the panels are kept uniformly in contact with one another using the flat plate. In this way, it is possible to prevent a gap formed between both of the panels due to their warping and to prevent the frit seal from spreading into the gap between both of the panels. Moreover, it is unnecessary to vary conditions for burning the frit seal. The frit seal is therefore burned on condition that the pin electrodes 6 can be coated adequately.

With the above arrangement, the method may comprise the steps of: placing both of the front panel and the rear panel stacked to the front panel on a base plate having a flat face; and securing the flat plate to the base plate by screws. In this way, the front panel and the rear panel are sandwiched between the flat plate and the base plate to keep the both panels in contact with one another. It is therefore possible to reliably prevent the spread of the frit seal into the gap between the both panels on application of the frit seal and on burning.

With the above arrangement, the method may comprise the steps of: placing both of the front panel and the rear panel stacked to the front panel on a base plate having a flat face; and securing the flat plate to the base plate by screws through a plurality of biasing means. In this way, the front panel and the rear panel are sandwiched between the flat plate and the base plate to keep the both panels in contact with one another. It is therefore possible to reliably prevent the spread of the frit seal into the gap between the both panels on application of the frit seal and on burning.

With the above arrangement, the frit seal, which is applied to the end of the front panel and the side face of the rear panel, may have flowability less than the frit seal applied to the pin electrodes. In this way, it is possible to reduce the amount of the frit seal, which spreads from the margins of the both panels into the gap, to the minimum level.

We provide a method for fabricating a flat, light-emitting display panel including a transparent, front panel, a rear panel arranged in parallel to the front panel and having a plurality of recesses, each recess being defined as a discharging space for a display cell, a pin electrode projected inwardly in a state of penetrating the rear panel, and a pair of cell-type electrodes, which works at the presence of voltage from the pin electrodes, arranged at every area of the front panel facing each of the recesses of the rear panel, wherein the method comprises the steps of: applying frit seal to an end of the front panel and a side face of the rear panel in a state of pressing the rear panel against the front panel to keep them in contact with one another using a flat plate having an opening formed at a position corresponding to each of the pin electrodes; drying the frit seal to fix provisionally the rear panel to the front panel; detaching the flat plate from the both panels; applying frit seal to the pin electrodes; and burning the whole of components. In this way, both of the panels are fixed provisionally on condition that the panels are kept uniformly in contact with one another using the flat plate. In this way, it is possible to prevent a gap formed between both of the panels due to their warping and to prevent the frit seal from spreading into the gap between both of the panels. Moreover, it is unnecessary to vary conditions for burning the frit seal. The frit seal is therefore burned on condition that the pin electrodes 6 can be coated adequately.

With the above arrangement, the method may comprise the steps of: placing both of the front panel and the rear panel stacked to the front panel on a base plate having a flat face; and securing the flat plate to the base plate by screws. In this way, the front panel and the rear panel are sandwiched between the flat plate and the base plate to keep the both panels in contact with one another. It is therefore possible to reliably prevent the spread of the frit seal into the gap between the both panels on application of the frit seal and on burning.

With the above arrangement, the method may comprise the steps of: placing both of the front panel and the rear panel stacked to the front panel on a base plate having a flat face; and securing the flat plate to the base plate by screws through a plurality of biasing means. In this way, the front panel and the rear panel are sandwiched between the flat plate and the base plate to keep the both panels in contact with one another. It is therefore possible to reliably prevent the spread of the frit seal into the gap between the both panels on application of the frit seal and on burning.

With the above arrangement, the frit seal, which is applied to the end of the front panel and the side face of the rear panel, may have flowability less than the frit seal applied to the pin electrodes. In this way, it is possible to reduce the amount of the frit seal, which spreads from the margins of the both panels into the gap, to the minimum level.

BEST MODES FOR CARRYING OUT THE INVENTION

To explain the invention more in detail, the best modes of carrying out the invention will be described with reference to the accompanying drawings.

Embodiment 1

Figure 1:
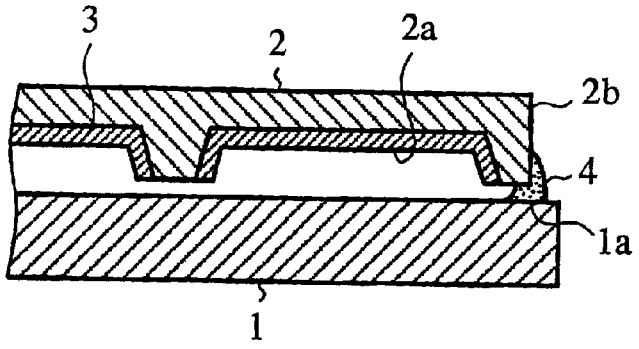
FIG. 1 is a cross sectional view of a side-seal structure of the flat, light-emitting display panel disclosed in the previous application.
Figure 2:
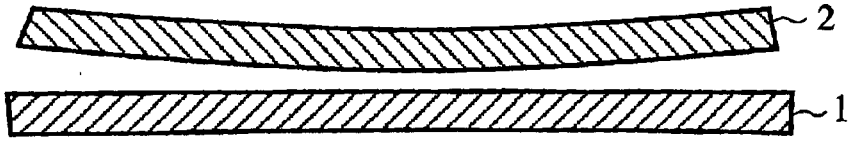
FIG. 2 is a cross sectional view of a state of warping occurred in the front and rear panels.
Figure 3:
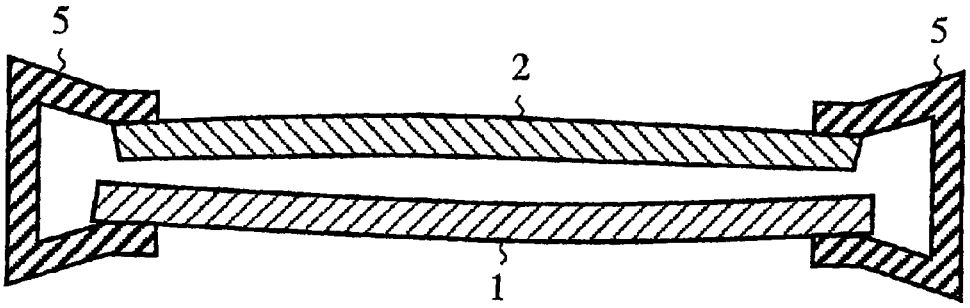
FIG. 3 is a cross sectional view for explaining a method of correcting the warping occurred in the front and rear panels, shown in FIG. 2.
Figure 4:
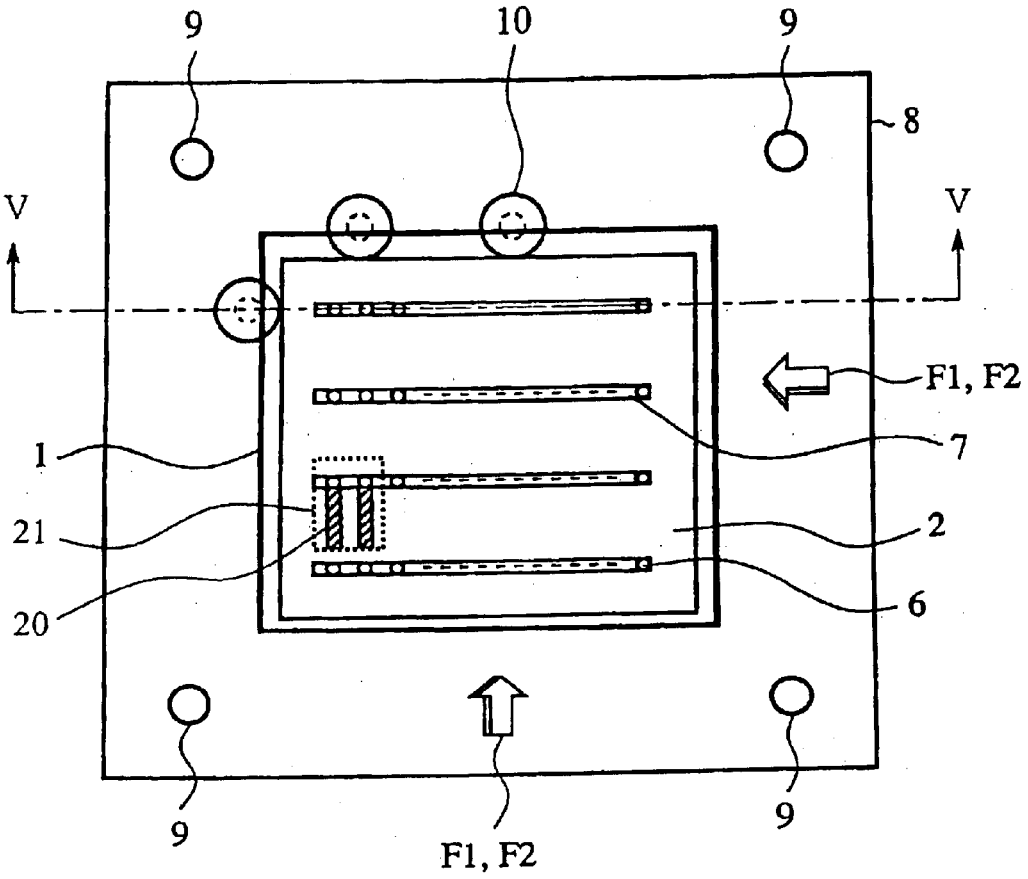
FIG. 4 is a plan view for explaining the first half of process in a method for fabricating a flat, light-emitting display panel as embodiment 1 according to the invention.
Figure 5:
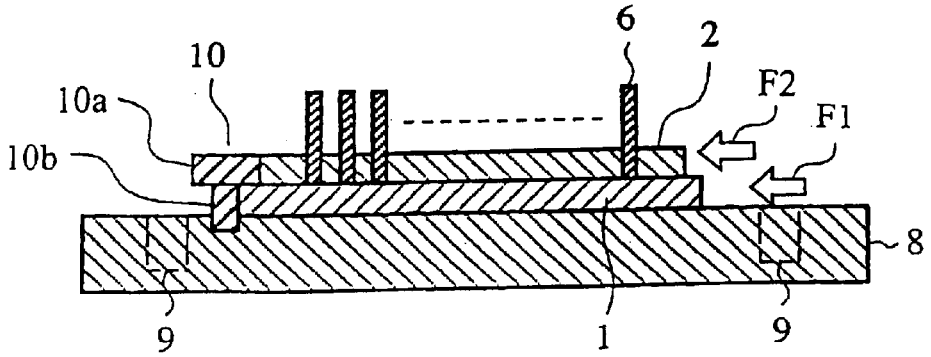
FIG. 5 is a cross sectional view taken along lines V—V of FIG. 4.
Figure 6:
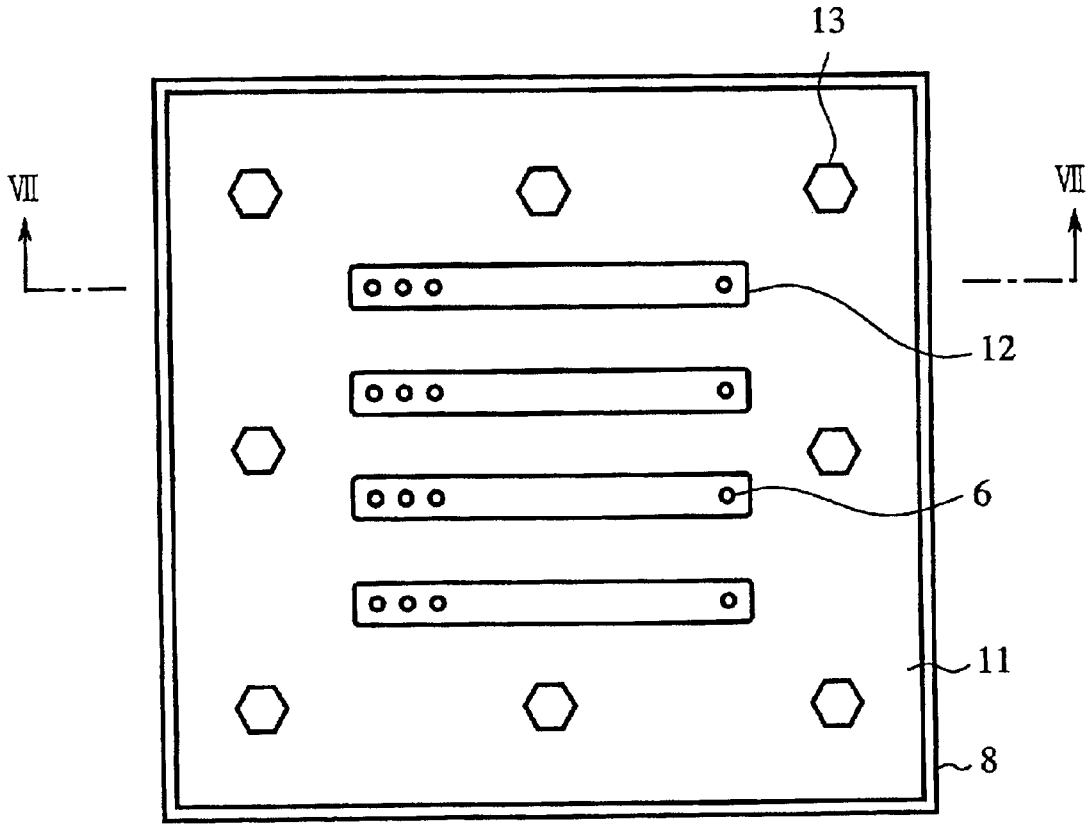
FIG. 6 is a plan view for explaining the second half of process in the method for fabricating a flat, light-emitting display panel as embodiment 1 according to the invention.
Figure 7:
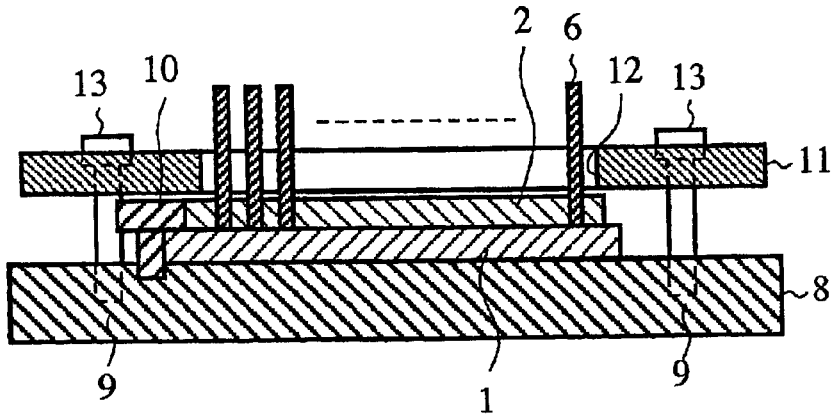
FIG. 7 is a cross sectional view taken along lines VII—VII of FIG. 6.
Figure 8:
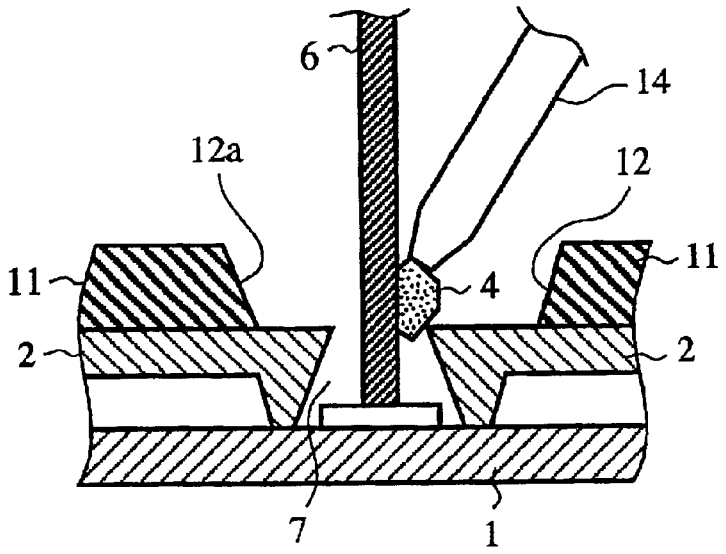
FIG. 8 is an enlarged cross sectional view for explaining a process of application of the frit seal to the pin electrode in the method for fabricating a flat, light-emitting display panel as embodiment 1 according to the invention.

FIG. 4 is a plan view for explaining the first half of process in a method for fabricating a flat, light-emitting display panel as embodiment 1 according to the invention. FIG. 5 is a cross sectional view taken along lines V—V of FIG. 4. FIG. 6 is a plan view for explaining the second half of process in the method for fabricating a flat, light-emitting display panel as embodiment 1 according to the invention. FIG. 7 is a cross sectional view taken along lines VII—VII of FIG. 6. FIG. 8 is an enlarged cross sectional view for explaining a process of application of the frit seal to the pin electrode in the method for fabricating a flat, light-emitting display panel as embodiment 1 according to the invention. Moreover, components of the embodiment 1, which are common to the components shown in FIG. 1 to FIG. 3 disclosed in the previous application, are denoted by the same reference numerals and further description will be omitted.

In the drawing, a reference numeral 6 denotes a plurality of pin electrodes mounted on electrodes of the front panel 1. A reference numeral 7 denotes a slit-shaped through hole formed at the rear panel 2 and allowing the penetration of the pin electrodes 6. A reference numeral 8 denotes a locating purpose base plate (base plate) for setting a relative location between the front panel 1 and the rear panel 2. A reference numeral 9 denotes screw holes formed in the four corners of the base plate 8. A reference numeral 10 denotes a location purpose pin projected from a required position of the base plate 8. The location purpose pin 10 is a tier-pin. A diameter of an upper section 10*a* of the pin 10 is set to be larger than that of a lower section 10*b* of the pin 10 by one-half of difference in length between one edge of the front panel 1 and one edge of the rear panel 2. The upper section 10*a* comes in contact with a side section of the rear panel 2 and the lower section 10*b* comes in contact with a side section of the front panel 1.

Next, a method for fabricating a display panel as the embodiment 1 will be explained in order of undergoing process.

First, the stacked panels 1 and 2 are placed on the base plate 8. At this time, the pin electrode 6 of the front panel 1 is passed through the slit-shaped through hole 7 of the rear panel 2 as shown in FIG. 4 and FIG. 5. The side of the front panel 1 is pressed against the lower section 10*b* of the location purpose pin 10 due to a force indicated by arrow F1. At the same time, the side of the rear panel 2 is pressed against the upper section 10*a* of the location purpose pin 10 due to a force indicated by arrow F2. In this way, both of the front panel 1 and the rear panel 2 are centered. The force indicated by F1 and F2 may be produced by a manual operation, or by using a biasing force of spring and so on, or by using a tightening force of screws, or by using a pneumatic pressure.

Next, the rear panel 2 is pressed down by using a press plate (flat plate) 11 as shown in FIG. 6 and FIG. 7. Since the press plate 11 is provided with a slit-shaped hole 12 formed at a position corresponding to the pin electrode 6 as in the case of the slit-shaped through hole 7 of the rear panel 2, the pin electrode 6 is passed through the slit-shaped hole 12. Next, the press plate 11 is fixed provisionally to the base plate 8 using a screw 13 screwed in the screw hole 9. At this time, since the front panel 1 and the rear panel 2 are pressed against one another, the panels 1 and 2 can be kept uniformly in contact with one another. The screws 13 are fixed at the screw holes 9 formed at least at four corners of the base plate 8. Alternatively, as shown in FIG. 6, the screws 13 may be fixed at eight positions, for example, formed along the peripheries of the press plate 11, if necessary.

Next, both of the panels 1 and 2 are pressed across the whole of the panels due to the fix of the press plate 11 and the base plate 8. In such a condition, the frit seal 4 is applied to a base section of the pin electrode 6 within the slit-shaped through hole 7 of the rear panel 2 using a dispenser 14 as shown in FIG. 8. The pin electrode 6 is coated with the frit seal 4 through the slit-shaped through hole 7. Moreover, the press plate 11 must have a thickness to a certain extent in order to prevent it from deforming. When the press plate 11 is too thick, it is difficult to apply the frit seal 4 to the pin electrode 6. It is preferable that the press plate 11 is approximately 2 mm to 3 mm thick, and the invention is limited to this range. In order to facilitate the application of the frit seal 4, a tapered section 12*a* is formed at a peripheral section of the slit-shaped hole 12 formed at the press plate 11 as shown in FIG. 8.

Next, the frit seal 4 is dried, and then the both panels 1 and 2 are removed from a jig including the base plate 8 and the press plate 11. In such a condition, the pin electrode is fixed provisionally using the dried frit seal 4. The both panels 1 and 2 intend to deform due to a warping force of the panels exerted on the pin electrode 6 fixed provisionally as a fulcrum. However, both of the panels 1 and 2 are hardly deformed and plane in parallel with the base plate 8 because the pin electrodes 6 are arranged in close to the ends of the panels.

In such a condition, the frit seal 4 is applied to the side faces of the respective panels 1 and 2 using the dispenser 14. At this time, since both of the panels 1 and 2 are preferably fixed in a state of the both being plane, a gap between ends of the panels is reduced to a slight of 0.04 mm or less. Therefore, the amount of spread of the frit seal 4 into the gap becomes very little.

Next, the pipe-shaped, tipped section is fixed using the frit seal 4. The frit seal 4 is then burned on condition that the weights (not shown) are placed on both of the panels 1 and 2 to seal the margin of the both panels 1 and 2. Each of the weights has a hole through which the pin electrode 6 and the pipe-shaped, tipped section (not shown) are passed. The hole prevents the weights from pressing both of the panels 1 and 2 and allows a part other than the pin electrode 6 and so on to be pressed uniformly. Unless the pressure is exerted uniformly on both of the panels 1 and 2, the frit seal 4 softened on burning is spread into the cell.

As described above, according to the embodiment 1, both of the panels 1 and 2 are fixed provisionally on condition that the panels 1 and 2 are kept uniformly in contact with one another using the press plate 11. In this way, it is possible to prevent a gap formed between both of the panels 1 and 2 due to their warping and to prevent the frit seal 4 from spreading into the gap between both of the panels 1 and 2.

As described above, with the embodiment 1, it is unnecessary to vary conditions for burning the frit seal. The frit seal is therefore burned on condition that the pin electrodes 6 can be coated adequately.

Embodiment 2

Figure 9:
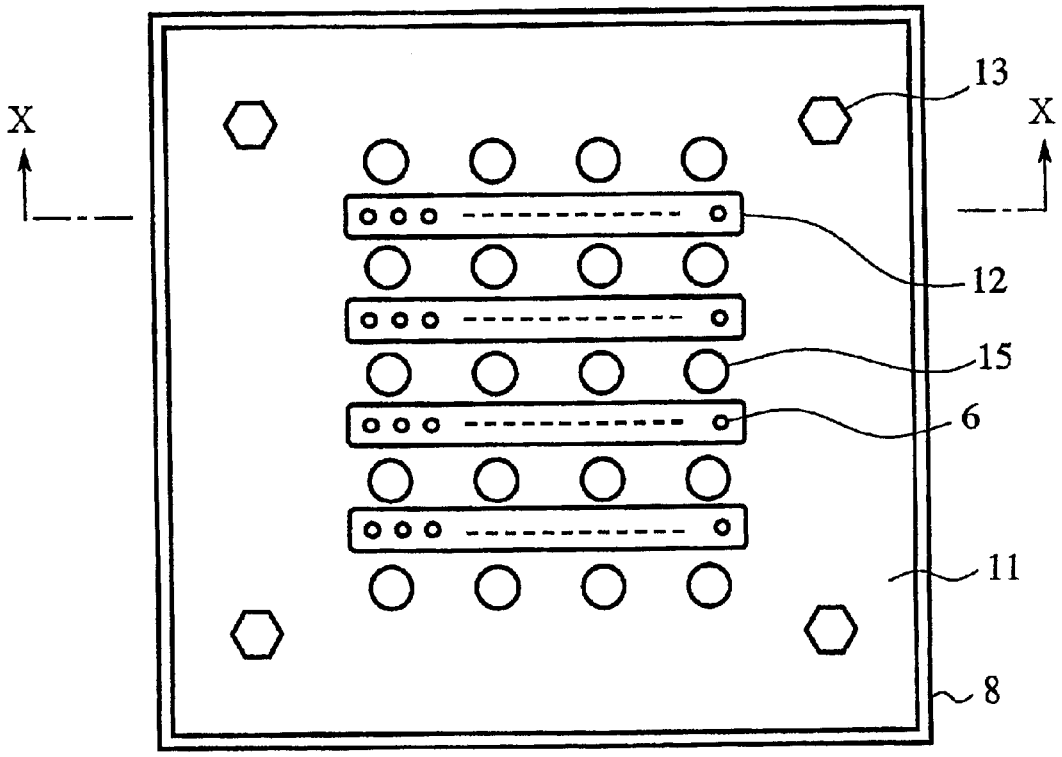
FIG. 9 is a plan view for explaining a process in the method for fabricating a flat, light-emitting display panel as embodiment 2 according to the invention.
Figure 10:
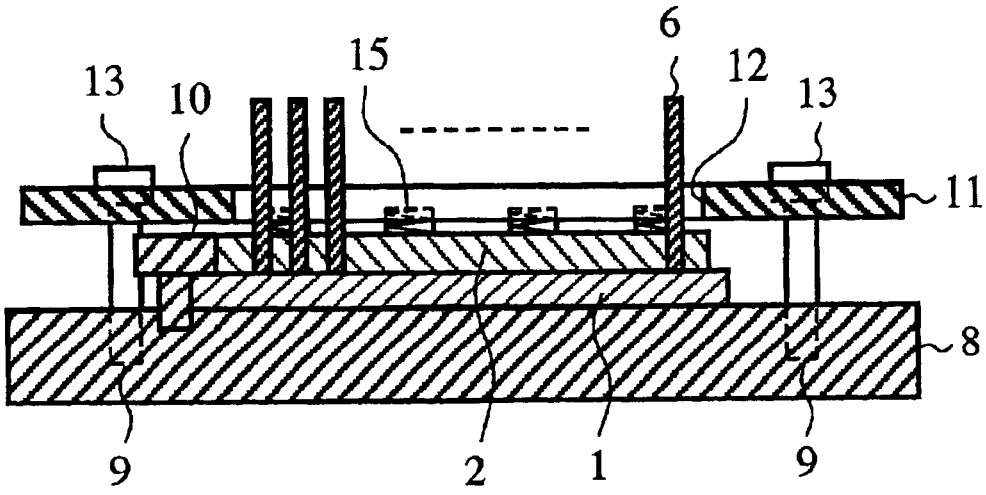
FIG. 10 is a cross sectional view taken along lines X—X of FIG. 9.
Figure 11:
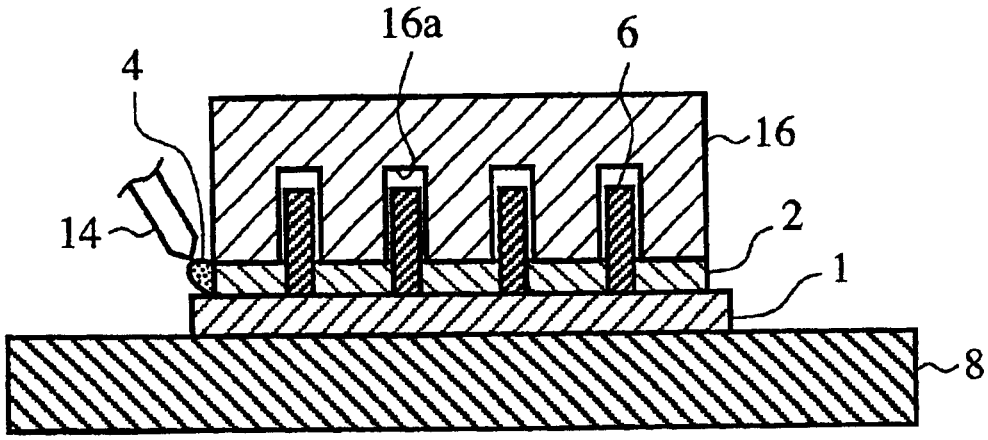
FIG. 11 is an enlarged cross sectional view for explaining a process in the method for fabricating a flat, light-emitting display panel as embodiment 3 according to the invention.
Figure 12:
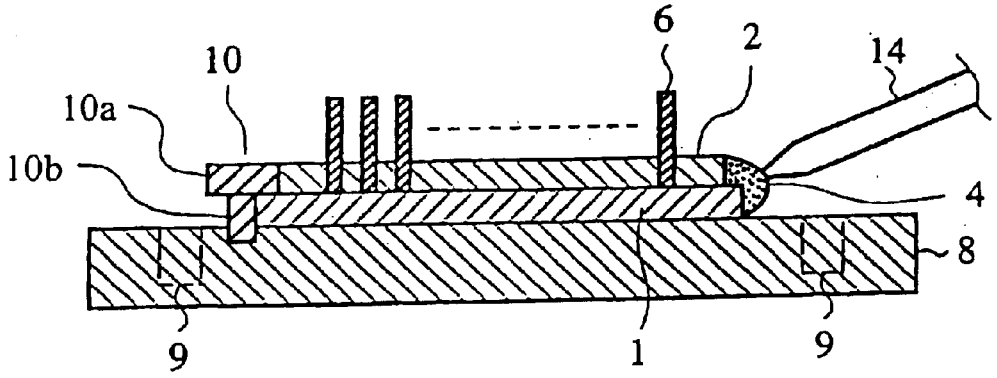
FIG. 12 is an enlarged cross sectional view for illustrating the process of applying the frit seal to the end of the front panel and the side of the rear panel with a flat plate detached in the method for fabricating a flat, light-emitting display panel as embodiment 1 according to the invention.
Figure 13:
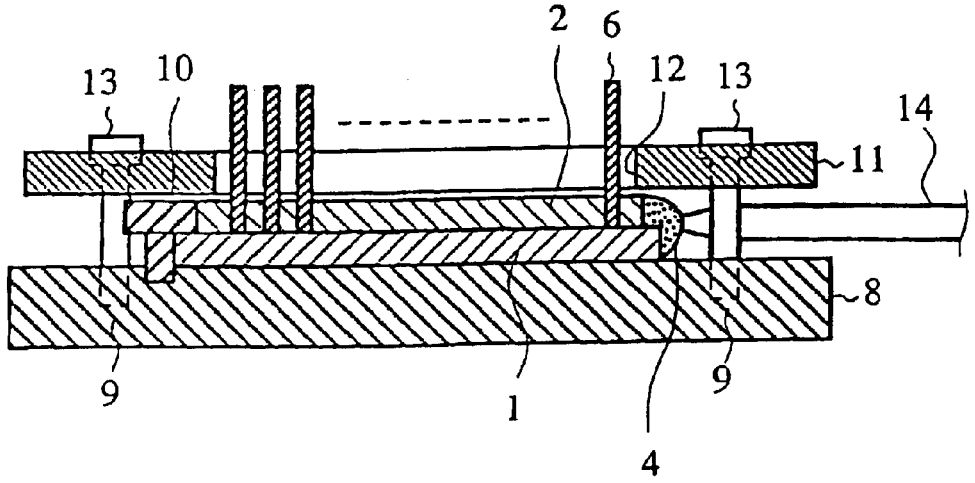
FIG. 13 is an enlarged cross sectional view for illustrating the process of applying the frit seal to the end of the front panel and the side of the rear panel with the rear panel pressed against the front panel with the flat panel in the method for fabricating a flat, light-emitting display panel as embodiment 1 according to the invention.

FIG. 9 is a plan view for explaining a process in the method for fabricating a flat, light-emitting display panel as embodiment 2 according to the invention. FIG. 10 is a cross sectional view taken along lines X—X of FIG. 9. Components of the embodiment 2 common to the components of the embodiment 1 are denoted by the same reference numerals and further description will be omitted.

The embodiment 2 is characterized in that a plural of coil springs (biasing means) 15 are disposed between the rear panel 2 and the press plate 11 at appropriate intervals. Each of the coil springs 15 works in a direction of increasing a distance between the rear panel 2 and the press plate 11. Since the distance is increased due to a biasing force of the coil spring 15, the front panel 1 and the rear panel 2 can be kept uniformly in contact with one another due to a stress of the press plate 11 exerted on the rear panel 2.

Moreover, with the embodiment 2, recesses allowing a part of the coil spring 15 defined as the biasing means to be inserted are formed in the lower face of the press plate 11. The biasing means is not limited to forms of the coil spring 15. Elastic body such as leaf springs, air springs, or rubber bush is available, and is used as appropriate in consideration of required contact characteristics or cost.

Embodiment 3

With the embodiment 1 or 2, the frit seal is applied to the pin electrode 6 and then the side of the panel. With the embodiment 3, the application of the frit seal is performed in inverse order. That is, with the embodiment 3, the frit seal is applied to the side of the panel on condition that the whole of the panels 1 and 2 is pressed uniformly, and is dried to fix provisionally the both panels 1 and 2. The frit seal is then applied to the pin electrode 6 and is burned.

According to the embodiment 3, the front panel 1 and the rear panel 2 are fixed provisionally on condition that the whole of the panels 1 and 2 is pressed uniformly as in the case of the embodiment 1 or 2. In this way, it is possible to prevent a gap formed between both of the panels 1 and 2 due to their warping and to prevent the frit seal 4 from spreading into the gap between both of the panels 1 and 2.

Moreover, with the embodiment 3, the press plate 8 is used in pressing uniformly the whole of the panels 1 and 2, as in the case of the embodiment 1 or 2. Alternatively, a weight 16 may be used in pressing uniformly them. That is, a recess 16*a*, which avoids coming in contact with the pin electrode 6, is formed in a lower face of the weight 16. The weight 16 is placed on the rear panel 2 stacked on the front panel 1. In such a state, the frit seal is applied to the side of the both panels 1 and 2. In this way, since the weight 16 is heavier than the press plate 11 in the embodiment 1 or 2, it is possible to reduce the gap between the both panels 1 and 2 to the limit and to prevent spread of the frit seal 4 with reliability. With the embodiment 3 of using the weight 16, since the press plate 11 has no use for pressing the panels, it is possible to reduce a component count and to simplify a fabricating process.

Moreover, the weight 16 pressing uniformly the both panels 1 and 2 may be preferably replaced by, for example, spring members, compressed air and so on.

Embodiment 4

The embodiment 4 is characterized in that a frit seal, which is applied to the side of the panels, has flowability less than a frit seal applied to the pin electrodes 6. In this way, it is possible to coat the electrode with the frit seal and to reduce the spread of the frit seal into the side of the panels.

The frit seal is a mixture of mixing PbO—B2O3 system glass powder, for example, with filler such ceramic powder.

Factors such as the quality of the filler, a mixing ratio, a particle diameter and so on are changed, and it is therefore possible to control the flowability of the frit seal. Examples of the combination of various kinds of frit each having different flowability includes LS-0118 and LS-0206 prepared by Japanese Electronics and Glass Co. Ltd., for example. The temperature condition in sealing such as 430 degrees centigrade for ten minutes or 450 degrees centigrade for fifteen minutes is recommended. That is, when two kinds of the frit seal is burned on the same temperature and the same period, the LS-0206 has flowability less than the LS-0118. Therefore, the LS-0118 having high flowability relative to the other is used to be applied to the pin electrode 6, and the LS-0206 having low flowability relative to the other is used to be applied to the side of the panels. The frit seal is burned at the temperature of 445 degrees centigrade for fifteen minutes. In this way, it is possible to coat perfectly the pin electrode 6 with the frit seal having high flowability, and to prevent entirely the spread of the frit seal having low flowability into the side of the panels. Moreover, the frit seal of LS-0118 is replaced by DT-430 prepared by Iwaki glass Co. Ltd., having the property as in the case of the two kinds of frit seal above.

As described above, according to the embodiment 4, since the various kinds of the frit seal are used depending on places to which they are applied, it is possible to improve image quality on request to the display panel.

INDUSTRIAL APPLICABILITY

As described above, a method for fabricating a flat, light-emitting display panel according to the invention is adequate to fabricate a display panel having no gap between a plurality of panels. The fabricated display panel is adequate for image on the large-screen comprised of panels tiled.

What is claimed is:

1. A method for fabricating a light-emitting display panel, the light-emitting display panel including a transparent front panel having a plurality of pin electrodes projecting from a surface thereof, a rear panel having a plurality of slit-shaped holes and a plurality of recesses, each of the plurality of recesses being a discharging space for each of a plurality of display cells, respectively, the rear panel being positioned parallel to the front panel, and each of a plurality of a pair of cell-type electrodes being positioned on the surface of the front panel corresponding to each of the plurality of recesses of the rear panel, respectively, the method comprising:

applying frit seal to the plurality of pin electrodes and a respective periphery thereof when the rear panel and front panel are pressed against one another using a flat plate such that the rear and front panels contact each other and the plurality of pin electrodes penetrates the rear panel through the plurality of slit-shaped holes, respectively, the flat plate having a flat face and each of a plurality of openings formed at a position corresponding to each of the plurality of pin electrodes, respectively;

drying the frit seal to fix the rear panel to the front panel provisionally;

detaching the flat plate from the front and rear panels;

applying frit seal to end sections of the front panel and side faces of the rear panel; and burning the frit seal.

2. A method for fabricating a light-emitting display panel according to claim 1 comprising:

placing the front panel having the rear panel being stacked thereon on a base plate having a flat face; and securing the flat plate to the base plate by a plurality of screws.

3. A method for fabricating a light-emitting display panel according to claim 1 comprising:

placing the front panel having the rear panel being stacked thereon on a base plate having a flat face; and securing the flat plate to the base plate by a plurality of screws and a plurality of biasing means.

4. A method for fabricating a light-emitting display panel according to claim 1, wherein the frit seal applied to the end sections of the front panel and the side faces of the rear panel has flowability less than the frit seal applied to the plurality of pin electrodes and the respective periphery thereof.

5. A method for fabricating a light-emitting display panel according to claim 1, wherein a size of the front panel being larger than a size of the rear panel.

6. A method for fabricating a light-emitting display panel, the light-emitting display panel including a transparent front panel having a plurality of pin electrodes projecting from a surface thereof, a rear panel having a plurality of slit-shaped holes and a plurality of recesses, each of the plurality of recesses being a discharging space for each of a plurality of display cells, respectively, the rear panel being positioned parallel to the front panel, and each of a plurality of a pair of cell-type electrodes being positioned on the surface of the front panel corresponding to each of the plurality of recesses of the rear panel, respectively, the method comprising:

applying frit seal to end sections of the front panel and side faces of the rear panel when the rear panel and front panel are pressed against one another using a flat plate such that the rear and front panels contact each other and the plurality of pin electrodes penetrates the rear panel through the plurality of slit-shaped holes, respectively, the flat plate having a flat face and each of a plurality of openings formed at a position corresponding to each of the plurality of pin electrodes, respectively;

drying the frit seal to fix the rear panel to the front panel provisionally;

detaching the flat plate from the front and rear panels;

applying frit seal to the plurality of pin electrodes and a respective periphery thereof; and burning the frit seal.

7. A method for fabricating a light-emitting display panel according to claim 6, further comprising:

placing the front panel having the rear panel being stacked thereon on a base plate having a flat face; and securing the flat plate to the base plate by a plurality of screws.

8. A method for fabricating a light-emitting display panel according to claim 6, further comprising:

placing the front panel having the rear panel being stacked thereon on a base plate having a flat face; and securing the flat plate to the base plate by the plurality of screws and a plurality of biasing means.

9. A method for fabricating a light-emitting display panel according to claim 6, wherein the frit seal applied to the end sections of the front panel and the side faces of the rear panel has flowability less than the frit seal applied to the plurality of pin electrodes and the respective periphery thereof.

10. A method for fabricating a light-emitting display panel according to claim 6, wherein a size of the front panel being larger than a size of the rear panel.

* * * * *